United States Patent [19]

Winnik et al.

[11] Patent Number: 4,562,135

[45] Date of Patent: Dec. 31, 1985

[54] POSITIVELY CHARGED COLOR TONER COMPOSITIONS

[75] Inventors: Francoise M. Winnik, Toronto; Trevor I. Martin, Burlington, both of Canada

[73] Assignee: Xerox Corporation, Stamford, Conn.

[21] Appl. No.: 630,463

[22] Filed: Jul. 13, 1984

[51] Int. Cl.[4] ..... G03G 9/08

[52] U.S. Cl. ..... 430/106; 430/106.6; 430/108; 430/110; 430/120

[58] Field of Search ..... 430/106, 108, 112, 106.6, 430/110, 120

[56] References Cited

U.S. PATENT DOCUMENTS

| | | | |
|---|---|---|---|
| 3,669,922 | 6/1972 | Bartsch et al. | 260/41 R |
| 3,826,747 | 7/1974 | Nagashima et al. | 252/62.1 |
| 4,006,163 | 2/1977 | Kölliker | 260/326 C |
| 4,145,299 | 3/1979 | Ford et al. | 430/106 |
| 4,291,112 | 9/1981 | Lu | 430/106 |
| 4,299,898 | 11/1981 | Williams et al. | 430/106 |
| 4,301,227 | 11/1981 | Hotta et al. | 430/106 |
| 4,356,244 | 10/1982 | Leichter et al. | 430/106 |

FOREIGN PATENT DOCUMENTS

| | | |
|---|---|---|
| 546586 | 9/1957 | Canada . |
| 547796 | 10/1957 | Canada . |

*Primary Examiner*—John L. Goodrow

*Attorney, Agent, or Firm*—E. O. Palazzo

[57] ABSTRACT

This invention relates to dry positively charged colored toner composition comprised of resin particles, and a dye charge control composition represented by the following formula:

X—A—C wherein X is a chromophore molecule, A is a linking group, and C is a triboelectric charge establishing group.

55 Claims, No Drawings

POSITIVELY CHARGED COLOR TONER COMPOSITIONS

BACKGROUND OF THE INVENTION

This invention is generally directed to toner compositions, and the use of these compositions in electrostatographic imaging systems. More specifically, the present invention is directed to colored toner and developer compositions, containing therein certain organic charge enhancing additives, which impart a positive charge to the toner resin particles. Toner and developer compositions with the charge enhancing additives of the present invention are useful in various electrostatographic imaging systems, particularly colored imaging systems, having incorporated therein as the photoresponsive member a layered imaging device which is negatively charged.

Toner and developer compositions, including colored developer compositions are well known. These compositions usually contain toner particles consisting of a resin and colorants, and carrier particles. With regard to colored developer compositions the colorants are usually selected from cyan dyes or pigments, magenta dyes or pigments, yellow dyes or pigments, or mixtures thereof. There is thus disclosed in U.S. Pat. No. 3,844,815, colored developer compositions containing as the yellow pigment Foron yellow, while U.S. Pat. No. 4,035,310, discloses colored toner compositions containing as a yellow pigment Yellow 97, and carrier particles generally comprised of steel coated with various polymeric resinous substances.

Several prior art patents also disclose the incorporation into toner compositions as separate components, charge enhancing additives primarily for the purpose of imparting a positive charge to the toner resin particles. Ther is thus disclosed in U.S. Pat. No. 4,298,672 positively charged toner compositions containing resin particles, and pigment particles, and as a charge enhancing additive alkyl pyridinium compounds and their hydrates of the formula as detailed in Column 3, beginning at line 14. Examples of alkyl pyridinium compounds disclosed include cetyl pyridinium chloride. Moreover, there is disclosed in U.S. Pat. No. 4,338,390 positively charged toner compositions having incorporated therein as charge enhancing additives various organic sulfate and sulfonate compositions, including stearyl dimethyl phenethylammoniumpara-toluene sulfonate. Further, in U.S. Pat. No. 3,893,935 there is described the use of quaternary ammonium salts as charge control agents for electrostatic toner compositions. In accordance with the disclosure of this patent, certain quaternary ammonium salts, when incorporated into a toner material, provided a composition which exhibited relatively high uniform stable net toner charge when mixed with a suitable carrier vehicle; which toner also exhibited a minimum amount of toner throw off.

Additionally there is disclosed in the prior art colored toner and developer compositions containing as charge enhancing additives para-halophenylcarboxylic acids, and the salts thereof. More specifically, there is disclosed in this patent positively charged toner compositions containing resin particles, dye particles, such as cyan, magenta, or yellow dyes, and as a charge enhancing additive, in an amount of from about 0.1 percent by weight to about 10 percent by weight, para-halophenylcarboxylic acids, and the salts thereof, including 4-fluorobenzoic acid, 4-chlorobenzoic acid, and 4-bromobenzoic acid.

While the above described toner and developer compositions are suitable for their intended purposes there continues to be a need for new developer compositions. Specifically there continues to be a need for colored toner compositions wherein a charge establishing group is desirably coupled to a chromophore or colorant, thereby providing anchoring by covalent bonding, allowing the resulting high molecular weight compounds to retain the charge establishing group therein. In contrast with many of the prior art charge enhancing additives they in many instances are undesirably leached from the toner composition, and thus must be continously monitored and replaced. Furthermore there remains a need for colored toner compositions wherein the charge establishing additive can be varied as desired depending on the colorant chromophore selected, and the triboelectric charge value to be imparted to the toner resin particles. Additionally there continues to be a need for colored toner compositions wherein the combined chromophore charge establishing group molecule is water insoluble, and therefore evidences reduced humidity sensitivity allowing the resulting triboelectric charge values imparted to the toner resins to be maintained at a relatively constant level. Further there remains a need for colored toner compositions in which dyes rather than pigments are employed as the colorants, thus imparting greater clarity and brightness to the resultant electrographic prints. There is also a need for dye colorants that are highly compatible with their host resinous material, and evidence substantially no tendency to leach, bleed, or sublime from the host resin.

SUMMARY OF THE INVENTION

It is therefore an object of the present invention to provide toner and developer compositions which overcome the above-noted disadvantages.

It is a further object of the present invention to provide colored toner and colored developer compositions which contain toner resin particles and carrier particles, wherein the toner particles are positively charged.

In another important object of the present invention there is provided positively charged colored toner compositions containing therein chromophores covalently linked to charge establishing groups.

In yet another object of the present invention there are provided positively charged colored toner compositions containing within a single molecular structure the chromophore of the colorant, such as a cyan chromophore, a magenta chromophore, or a yellow chromophore permanently attached to charge establishing groups, and wherein attachment is effected by spacer or linking molecules including alkylene groups.

In yet another object of the present invention there are provided positively charged colored toner compositions with chromophores or colorants covalently linked to charge establishing groups, and wherein the chromophore and charge establishing groups can contain thereon various solubilizing groups.

In still a further object of the present invention there are provided positively charged colored toner compositions, containing therein as one molecule chromophores permanently attached by covalent bonding to charge establishing groups.

In another object of the present invention there are provided toner compositions useful in color imaging systems, wherein electrostatic images are separately formed on various imaging members, followed by sequential development with the developer compositions of the present invention, transfer of the developed images to suitable substrates, and optionally permanently affixing thereon.

These and other objects of the present invention are accomplished by providing toner and developer compositions, containing as a colorant therein molecules of a chromophore attached to a charge establishing group. More specifically in accordance with one aspect of the present invention there are provided positively charged colored toner compositions comprised of resin particles, in which are dissolved dye molecules of the following formula, comprising a chromophore or colorant attached to charge establishing groups:

X—A—C wherein X represents a specific chromophore, A is a spacer or linking group, covalently attaching the chromophore to the charge establishing group C. These molecules also can contain solubilizing groups located on the chromophore, on the charge establishing group or on both, the X and C substituents. The presence of solubilizing groups provide for increased solubility and compatibility of the combined chromophore-charge establishing molecule with the toner resin.

With regard to compositions represented by the above formula illustrative examples of X groups include various chromophores or colorants, including cyan chromophores, magenta chromophores, yellow chromophores, or mixtures thereof. Examples of specific groups that may be selected as magenta chromophores include for example quinacridone residues, such as 2,9-dimethylquinacridone, diazo residues such as the dye identified in the color index as Cl 26050 or Cl Solvent Red 19, anthraquinone residues including those dyes identified in the color index as Cl 60710 or Cl Disperse Red 15, Cl 62015 or Cl Disperse Red 11, Cl 68210 or Solvent Red 52,1-amino-2-N-alkylamino-4-hydroxyanthraquinone, and the like. Illustrative examples of cyan chromophores that may be used are copper tetra-4-octadecylsulfonamide phthalocyanine, indanthren chromophores including that of the dye identified in the color index as Cl 69810, Special Blue X-2137, and anthraquinone chromophores such as that of the dye identified in the color index as Disperse Blue 60 or Serilene Brilliant Blue 2G, and the like. Illustrative examples of yellow chromophores that may be selected are 1-phenylthioanthraquinone, 1,5-bisphenylthioanthraquinone, 1,8-bis-phenylthioanthraquinone, diarylide yellow 3,3-dichlorobenzidene acetoacetanilides, monoazo chromophores inclusive of the dye identified in the color index as Cl 12700 or Cl Solvent Yellow 16, nitrophenylamino sulfonamides such as that of the dye identified in the color index as Foron Yellow SE/SCW, or Cl Disperse Yellow 42, monoazo chromophores such as that of the dye identified in the color index as Permanent Yellow FGL or Cl Pigment Yellow 97, and other similar dyes.

There can be selected as the linker or spacer substituents those groups which will covalently bond the chromophore X to the charge establishing group C, while simultaneously insulating the chromophores from any adverse characteristics inclusive of a change in the color intensity or hue resulting from electronic effects from the charge establishing groups. Accordingly thus examples of linking substances A include various alkylenes, like ethylene, propylene, isopropylene, butylene, isobutylene, pentylene, hexylene (linear or branched), heptylene (linear or branched) and similar groupings, with propylene and hexylene being preferred. Other spacer groups that can be selected include alkoxyalkylenes, such as polyoxyethylene and polyoxypropylene; and the like.

One primary advantage of the present invention resides in the degree of flexibility provided for the selection of the charge establishing group, as this group can be derived from many known materials depending for example on the required triboelectric charging level desired for the resulting toner composition. Other criteria for the selection of the charge establishing group include toxicity properties, and the rate of accumulation of triboelectric charge of uncharged toner particles when mixed with previously charged toner particles. Also since the charge establishing group is electronically insulated from the chromophore portion of the molecule or the dye, a change in the chemical structure of the charge establishing group has substantially no influence on the chromophore properties of the dye molecule.

Illustrative examples of charge establishing groups C include materials selected from amines, quaternary ammonium salts, ethers, thioethers, esters, thioesters, sulfonamides, sulfonates, amides, biguanides, and the like. The preferred charge establishing groups for several of the developer compositions of the present invention are amines, quaternary ammonium salts, esters, and the like. More specifically as charge establishing groups there can be selected amino, dimethylamino, diethylamino, dipropylamino, dibutylamino, pipecolino, morpholino, cyclohexylamino, cyclopentylamino, methoxy, ethoxy, isopropoxy, thiomethoxy, thioethoxy, thiobutoxy, o-methoxyphenylamino, p-methoxyphenylamino, pyrrolidino, methylpyrrolidino, n-butanoyl, n-pentanoyl, n-hexanoyl, n-heptanoyl, n-octanoyl, di-(2-n-octanoylethyl)-amino, m-trifluoromethylbenzoyl, p-trifluoromethylbenzoyl, N,N,N-trimethylammonium tetrafluoroborate, N,N-diethyl-N-methylammonium tetrafluoroborate, N,N-di-n-butyl-N-methylammonium tetrafluoroborate, N,N,N-trimethylammonium tosylate, p-toluenesulfonamide, and other similar groups.

Substances of the above formula, X—A—C, can also have incorporated therein solubilizing groups attached to the chromophore and/or the charge establishing group. These solubilizing groups are added for the primary purpose of increasing the solubility of the complete dye molecule in the toner resin of choice.

Examples of solubilizing groups that can be selected include alkyl groups such as ethyl, propyl, isopropyl, butyl, isobutyl, tertiary butyl pentyl (branched and linear), hexyl (branched and linear). heptyl (branched and linear), octyl (branched and linear), and the like.

Specific molecules encompassed by the formula X—A—C, include for example N-(N',N'-dimethyl-3'-aminopropyl)1,4-diaminoanthraquinone-2,3-dicarboximide, N-(N',N'-diethyl-3'-aminopropyl) 1,4-diaminoanthraquinone-2,3-dicarboximide, N-(N',N'-di-n-butyl-3'-aminopropyl)1,4-diaminoanthraquinone-2,3-dicarboximide, N-(N'-cyclohexyl-3'-aminopropyl)1,4-diaminoanthraquinone-2,3-dicarboximide, N-3'-isopropoxypropyl 1,4-diaminoanthraquinone-2,3-dicarboximide, N-(o-methoxyphenethyl)1,4-diaminoanthraquinone-2,3-dicarboximide, N-(6'-n-octanoylhexyl)1,4-diaminoanthraquinone-2,3-dicarboximide, N-[di-(2'-n-octanoylethyl)-3'-aminopropyl]1,4-diaminoanthraquinone-2,3-dicarboximide, N-[6'-(p-trifluoromethylbenzoyl)-hexyl]1,4-diaminoanthraquinone-2,3-dicarboximide, N-(N',N',N'-trimethyl-3'-ammonium-propyl)1,4-diaminoanthraquinone-2,3-dicarboximide tetrafluoroborate, N-(N',N',N'-trimethyl-3'-ammoniumpropyl)1,4-diaminoanthraquinone-2,3-dicarboximide tosylate, N-(N',N',N'-trimethyl-3'-ammoniumpropyl)1,4-diaminoanthraquinone-2,3-dicarboximide chloride, N-(N',N'-diethyl-N'-methyl-3'-ammoniumpropyl)1,4-diaminoanthraquinone-2,3-dicarboximide tetrafluoroborate, N-(N',N'-di-n-butyl-N'-methyl-3-ammoniumpropyl)1,4-diaminoanthraquinone-2,3-dicarboximide tetrafluoroborate, 1-amino-2-[N',N'-di-n-butyl-6'-aminohexyl-amino]-4-hydroxyanthraquinone, 1-amino-4-hydroxy-2-(6'-n-octanoylhexyl-1'-amino)-anthraquinone, 1-amino-4-hydroxy-2-(N',N',N'-trimethyl-6'-ammonium)-hexyl-1'-aminoanthraquinone tetrafluoroborate, 1-amino-2-(N,N-di-n-butyl-6-amino-hexyloxy)4-hydroxyanthraquinone, 1-(4'-[N,N-di-methyl-6''-aminohexyl]phenylthio)-5-phenylthioanthraquinone, and 1-[4'N,N,N-trimethyl-6''-ammonium-hexyl]phenylthio-5-phenylthioanthraquinone.

Various suitable resins can be selected for obtaining the toner composition of the present invention, typical resins including for example polyamides, polycarbonates, diolefins, epoxies, polyurethanes, vinyl resins and polyesters. Any suitable vinyl resin may be selected including homopolymers or copolymers of two or more vinyl monomers. Typical of such vinyl monomeric units include: styrene, p-chlorostyrene vinyl naphthalene, unsaturated mono-olefins such as ethylene, propylene, butylene, isobutylene and the like; diolefins such as 1,3-butadiene, isoprene and the like; vinyl halides such as vinyl chloride, vinyl bromide, vinyl fluoride; vinyl esters inclusive of vinyl acetate, vinyl propionate, vinyl benzoate, vinyl butyrate and the like; esters of unsaturated monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, such as vinyl methyl ether, vinyl isobutyl ether, vinyl ethyl ether, and the like; vinyl ketones like vinyl methyl ketone, vinyl hexyl ketone, methyl isopropenyl ketone and the like; vinylidene halides including vinylidene chloride, vinylidene chlorofluoride and the like; N-vinyl indole, N-vinyl pyrrolidone and the like; styrene butadiene copolymers, and mixtures thereof.

As one preferred toner resin there can be selected the esterification products of a dicarboxylic acid and a diol comprising a diphenol. These materials are illustrated in U.S. Pat. No. 3,655,374, the disclosure of which is totally incorporated herein by reference, the diphenol reactant being of the formula as shown in Column 4, beginning at line 5 of this patent and the dicarboxylic acid being of the formula as shown in Column 6. Other preferred toner resins include styrene/methacrylate copolymers, and styrene/butadiene copolymers, available from Goodyear Chemicals as Pliolites, polyester resins obtained from the reaction of bis-phenol A and propylene oxide, followed by the reaction of the resulting product with fumaric acid, and branched polyester resins resulting from the reaction of dimethylterephthalate, 1,3-butanediol, 1,2-propanediol, and pentaerythritol.

The toner resins identified herein are present for example in the toner composition in an amount of from about 85 percent by weight to about 99.9 percent by weight, and preferably in an amount of from about 90.0 percent by weight to about 96.0 percent by weight; while the molecules comprised of the chromophore attached to the charge establishing group by a linking material are present in the toner composition in an amount of from about 0.1 percent by weight to about 15.0 percent by weight, and preferably in an amount of from about 4.0 percent by weight to about 10.0 percent by weight.

Illustrative examples of carrier particles that can be selected for mixing with the toner composition of the present invention include those substances that are capable of triboelectrically obtaining a charge of opposite polarity to that of the toner particles. Accordingly, the carrier particles of the present invention are selected so as to be of a negative polarity, causing the toner particles which are positively charged to adhere to and surround the carrier particles. Illustrative examples of carrier materials include granular zircon, granular silicon, polymethyl methyl methacrylate, glass, steel, nickel, iron ferrites, silicon dioxide, and the like. Additionally, there can be selected as carrier particles nickel berry carriers as disclosed in U.S. Pat. No. 3,847,604, the disclosure of which is totally incorporated herein by reference. These carriers are comprised of nodular carrier beads of nickel, characterized by surfaces of reoccurring recesses and protrusions thereby providing particles with a relatively large external area.

The selected carrier particles can be used with or without a coating, the coating generally comprising polyvinylidene resins, terpolymers of styrene, methylmethacrylate, and a silane, such as triethoxy silane, tetrafluoroethylenes, other fluorocarbon polymers, and the like.

The diameter of the carrier particles can vary, generally however these materials are from about 50 microns to about 1,000 microns in diameter, enabling the carrier particles to possess sufficient density and inertia to avoid adherance to the electrostatic images during the development process. The carrier particles can be mixed with the toner particles in various suitable combinations, however, from about 1 part per toner to about 10 parts to about 200 parts by weight of carrier are mixed.

The toner and developer compositions of the present invention can be prepared by a number of known methods, including melt blending the toner resin particles, and the chromophore molecule of the present invention, followed by mechanical attrition. Other methods include those well known in the art such as spray drying, melt dispersion, extrusion, dispersion polymerization, and suspension polymerization. In one dispersion method, a solvent dispersion of the resin particles, and dye molecule are spray dried under controlled conditions to result in the desired product. Toner compositions prepared in this manner result in a positively, or in some instances depending on the carrier selected, a negatively charged toner composition. More specifically thus toner compositions containing the dye charge control compounds described herein can be prepared by blending the dye molecule into the resin by extrusion. Thus a physical mixture of colorant and resin is fed into a known twin-screw extruder at feed rates of from about 10 grams/minute, to about 30 grams/minute, and preferably from about 18 grams/minute to about 25 grams/minute. The temperature of the extruder barrel is maintained at about 130° C. to about 160° C., and preferrably from about 145° C. to about 155° C. In a first step a Fitz mill is used to grind the extrudate into particles having an average diameter of from about 100 microns to about 60 microns, and preferably from about 70 microns to about 80 microns. In a second step this powder is micronized to an average particle size from about 6 microns to about 15 microns, and preferably from 8 microns to about 10 microns.

The triboelectric charge present on the toner resin particles depends primarily on the charge establishing group selected, generally however this charge is from about 10 microcoulombs per gram to about 100 microcoulombs per gram, and preferably from about 20 microcoulombs per gram to about 60 microcoulombs per gram.

The toner and developer compositions of the present invention may be selected for use in developing images in electrostatographic imaging systems, particularly colored images, on various suitable imaging surfaces capable of retaining charge such as those surfaces where a negative charge resides on the photoreceptor. The imaging method comprises contacting the electrostatic latent image with the developer compositions of the present invention followed by transferring the resulting image to a suitable substrate, and optionally permanently affixing the image by heat, or by exposure to solvent vapor. Examples of layered organic photoreceptors that can be selected as the imaging members include those comprised of transport layers and photogenerating layers, reference U.S. Pat. No. 4,265,990, the disclosure of which is totally incorporated herein by reference, and other similar layered photoresponsive devices. Useful photogenerating layers include those comprised of trigonal selenium, metal phthalocyanines, metal free phthalocyanines, vanadyl phthalocyanines, squaraine pigments, and azo pigments, while examples of charge transport layers encompass the diamines as disclosed in U.S. Pat. No. '990, hydrazones, and the like. A preferred photoresponsive device useful in the present invention contains a supporting substrate such as aluminum, a photogenerating layer of trigonal selenium, about 75 to 80 percent by volume dispersed in about 20 to 25 percent by volume of a polyvinylcarbazole resinous binder, and an amine transport layer with about 50 percent by weight of the amine molecule N,N'-diphenyl-N,N'bis(3-methylphenyl)1,1-biphenyl-4,4-diamine, dispersed in a polycarbonate resinous binder 50 percent by weight. This photoconductive device is negatively charged rendering the positively charged toner compositions of the present invention highly useful for development of latent electrostatic images contained on the surface thereof.

The cyan charge enhancing dyes of the present invention can be prepared by a number of known procedures including the reaction of for example 1,4-diaminoanthraquinone-2,3-dicarboximide with primary amines. The dicarboximide reactant is prepared from bromaminic acid, sodium salt as described for example in German patent publication DE No. 3003 656, the disclosure of which is totally incorporated herein by reference. Moreover the dicarboximide composition can be prepared by the hydrolysis of 1,4-diamino-2,3-dicyanoanthraquinone as described in U.S. Pat. No. 2,628,963, the disclosure of which is totally incorporated herein by reference.

Other cyan charge controlling molecules can be obtained by reaction transformations on the functional group attached to the linker, or spacer molecule, including the conversion of alcohols to esters, to sulfonates, and the like; the conversion of amines to amides, sulfonamides, quaternary ammonium salts and the like. The formation of the quaternary ammonium salts can be effected as detailed in U.S. Pat. No. 2,701,801, the disclosure of which is totally incorporated herein by reference. Further the cyan charge controlling molecules can be prepared as described in U.S. Pat. No. 2,701,801, wherein there is disclosed the preparation of N-(N',N'-dimethylaminopropyl)1,4-diaminoanthraquinone-2,3-dicarboximide by reacting 1,4-diaminoanthraquinone-2,3-dicarboximide and N,N-dimethyl-1,3-propane diamine.

The yellow charge enhancing dyes of the present invention can be prepared by the reaction of 1,5-dichloroanthraquinone with thiophenols, including thiophenol, para-amino-thiophenol, paramethoxythiophenol, and the like. Other yellow dyes can be obtained by the transformations of the functional groups attached to the thiophenol group.

The magenta charge enhancing dyes of the present invention can be prepared by the reaction of 1-amino-2-bromo-4-hydroxyanthraquinone, with primary amines. Other magenta dyes can be obtained by the reaction of the functional group attached to the linker substituents, including the conversion of amines to amides, sulfonamides, quaternary ammonium salts, and the like.

Examples of suitable amines are N,N-dimethyl-1,3-propane diamine, N,N-diethyl-1,3-propane diamine, N,N-di-n-butyl-1,3-propane diamine, 1-(3-aminopropyl)-2-pipecoline, N-(3-aminopropyl)morpholine, 1,3-propane diamine, N-cyclohexyl-3-aminopropylamine, 3-aminopropanol, 6-aminopropanol, 3-isopropoxypropylamine, o-methoxyphenethylamine, p-methoxyphenethylamine, N-aminopropylpyrrolidone, 2-(2-aminoethyl)-N-methylpyrrolidine, and N-(3-aminopropyl)-diethanolamine.

The following examples are being supplied to further define embodiments of the present invention, it being noted that these examples are intended to illustrate and not limit the scope of the present invention. Parts and percentages are by weight unless otherwise indicated. The triboelectric charge of toner composition involved were determined by blow-off measurements on developer compositions containing the toner, (concentration of about 1% to about 6%) and carrier particles (concentration from about 94% to about 99% by weight). Blow-off measurements were then performed on the developer mixtures roll-milled for 10 minutes, 30 minutes, 1 hour, and 3 hours as indicated. The equilibrium triboelectric charge varies from about +10 microcoulombs per gram to about +80 microcoulombs per gram and preferably from +20 microcoulombs per gram to +40 microcoulombs per gram, depending on the choice of charge controlling group attached to the dye chromophore.

EXAMPLE 1

There was prepared N-(N',N'-Dimethyl-3'-aminopropyl)1,4-diaminoanthraquinone-2,3-dicarboximide by forming a suspension of 1,4-diaminoanthraquinone-2,3-dicarboximide (20.0 parts,) and N,N-dimethyl-1,3-propane diamine (16.6 parts) in methoxyethanol (300.0 parts), followed by heating at 120° C. for 5 hours. The reaction mixture was then cooled to room temperature, followed by cooling in ice for several hours. Thereafter the resulting mixture was filtered and washed with methanol (300.0 parts). The product obtained was dried in vacuo for 8 hours at 45° C. resulting in N-(N',N'-dimethyl-3'-aminopropyl)1,4-diaminoanthraquinone-2,3-dicarboximide (23.8 parts, 93%) (Formula 1); m.p.: 215°-216° C., lambdamax 678 nm.

Calc. for $C_{21}H_{20}N_4O_4$: C, 64,28; H, 5.14; N, 14.28; Found: C, 63.87; H, 5.19; N, 14.19.

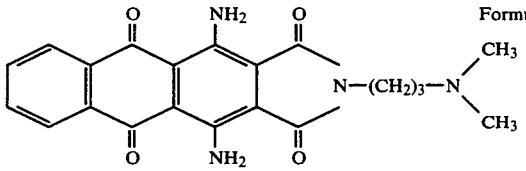

Formula 1:

EXAMPLE II

There was prepared N-(N',N'-diethyl-3'-aminopropyl)1,4-diaminoanthraquinone-2,3-dicarboximide by forming a suspension of 1,4-diamionanthraquinone-2,3-dicarboximide (40.0 parts) and N,N-diethyl-1,3-propane diamine (42.4 parts) in methoxyethanol (500.0 parts) followed by heating at 120° C. for 5 hours. The reaction mixture was cooled to room temperature, followed by cooling in ice for several hours. Thereafter the resulting mixture was filtered and washed with methanol (600.0 parts). The product obtained was dried in vacuo for 8 hours at 45° C. yielding N-(N',N'-diethyl-3'-aminopropyl)1,4-diaminoanthraquinone-2,3-dicarboximide (46.1 parts, 86%) (Formula 2); m.p.: 167°-168° C.; lambdamax 678 nm.

Calc. for $C_{23}H_{24}N_4O_4$: C, 65.70; H, 5.75; N, 13.33; Found: C, 65.40; H, 5.89; N, 13.11

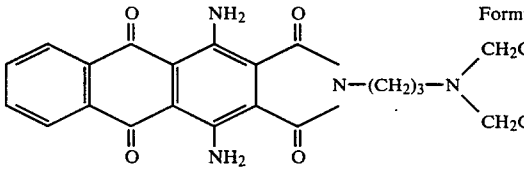

Formula 2:

EXAMPLE III

There was prepared N-(N',N'-di-n-butyl-3'-aminopropyl)1,4-diaminoanthraquinone-2,3-dicarboximide by forming a suspension of 1,4-diaminoanthraquinone-2,3-dicarboximide (40.0 parts) and N,N-dibutyl-1,3-propane diamine (60.8 parts) in methoxyethanol (500.0 parts) followed by heating at 120° C. for 5 hours. The reaction mixture was cooled to room temperature, followed by cooling in ice for several hours. Thereafter the resulting mixture was filtered and washed with methanol (600.0 parts). The product obtained was dried in vacuo for 8 hours at 45° C. yielding N-(N',N'-di-n-butyl-3'-aminopropyl)1,4-diaminoanthraquinone-2,3-dicarboximide (53.0 parts, 85%), (Formula 3); m.p.: 106°-106.5° C.; lambdamax 678 nm.

Calc. for $C_{27}H_{32}N_4O_4$: C, 68.04; H, 6.77; N, 11.76; Found: C, 68.25; H 6.77; N, 11.54.

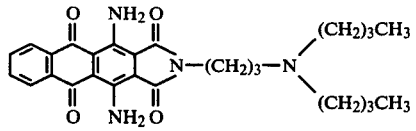

Formula 3:

EXAMPLE IV

There was prepared N-3-isopropoxypropyl 1,4-diaminoanthraquinone-2,3-dicarboximide by forming a suspension of 1,4-diaminoanthraquinone-2,3-dicarboximide (10.0 parts) and 3-isopropoxypropylamine (9.5 parts) in methoxyethanol (150.0 parts) followed by heating at 120° C. for 5 hours. The reaction mixture was cooled to room temperature, followed by cooling in ice for several hours. Thereafter the resulting mixture was filtered and washed with methanol (200.0 parts). The product obtained was dried in a vacuo for 8 hours at 45° C. yielding N-3-isopropoxypropyl 1,4-diaminoanthraquinone-2,3-dicarboximide (10.5 parts, 77%) (Formula 4); m.p.: 196°-197° C.; lambdamax 676 nm.

Calc. for $C_{22}H_{21}N_3O_5$: C, 64.85; H, 5.20; N, 10.31; Found: C, 64.31; H, 5.29; N, 10.82.

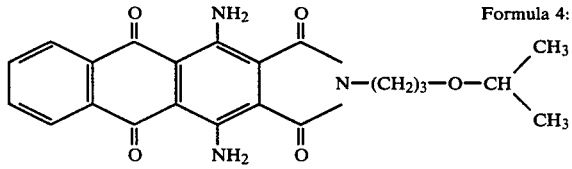

Formula 4:

EXAMPLE V

There was prepared N-(o-methoxyphenylethyl)1,4-diaminoanthraquinone-2,3-dicarboximide by forming suspension of 1,4-diaminoanthraquinone-2,3-dicarboximide (15.0 parts) and o-methoxyphenethylamine (18.5 parts) in methoxyethanol (200.0 parts) followed by heating at 120° C. for 5 hours. The reaction mixture was cooled to room temperature, followed by cooling in ice for several hours. Thereafter the resulting mixture was filtered and washed with methanol (200.0 parts). The product obtained was dried in vacuo for 8 hours at 45° C. yielding N-[N'-(o-methoxyphenyl)aminoethyl]1,4-diamino-anthraquinone-2,3-dicarboximide (17.8 parts, 80%) (Formula 5); m.p.: 241°-242° C.; lambdamax 672 nm.

Calc. for: $C_{25}H_{19}N_3O_5$: C, 68.02; H, 4.34; N, 9.10; Found: C, 68.30; H, 4.42; N, 9.34.

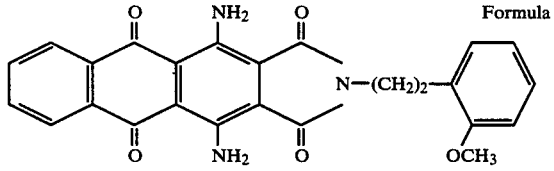

Formula 5:

EXAMPLE VI a. A suspension of 1,4-diaminoanthraquinone-2,3-dicarboximide (15.0 parts) and 6-aminopropanol (28.6 parts) in methoxyethanol (200.0 parts) was heated at 120° C. for 6 hours. The reaction mixture was cooled to room temperature, followed by cooling in ice for several hours. Thereafter the resulting mixture was filtered and washed with methanol (600 parts). The product obtained was dried in vacuo for 8 hours at 45° C. yielding N-(6'-hydroxyhexyl)1,4-diaminoanthraquinone-2,3-dicarboximide (17.1 parts, 83%); m.p.: 210°–211° C.

Calc. for: $C_{22}H_{21}N_3O_5$: C, 64.85; H, 5.20; N, 10.31; Found: C, 64.29; H, 5.33; N, 10.45.

b. A suspension of N-(6'-hydroxyhexyl)1,4-diaminoanthraquinone-2,3-dicarboximide (10.0 parts) in pyridine (200.0 parts) was heated to 90° C. under nitrogen and maintained at this temperature for 1 hour or until complete dissolution of the dye. The reaction mixture was cooled to 40° C. Caproyl chloride (6.9 parts) was then added dropwise at a rate such that the temperature did not exceed 50° C. The reaction mixture was cooled to room temperature. After 3 hours, ethanol (20.0 parts) was added dropwise. The mixture was cooled in ice for 3 hours. The dark blue solid obtained was separated by filtration and washed with methanol (100 parts). After drying in high vacuo for 6 hours at 45° C., there was obtained N-(6'-n-octanoylhexyl)1,4-diaminoanthraquinone-2,3-dicarboximide (11.5 parts, 88% from N-(6'-hydroxyhexyl)1,4-diaminoanthraquinone-2,3-dicarboximide) (Formula 6); m.p.: 157°–158° C.; lambdamax 680 nm.

Calc. for: $C_{30}H_{35}N_3O_6$: C, 67.52; H, 6.61; N, 7.88; Found: C, 67.20; H, 6.60; N, 7.56.

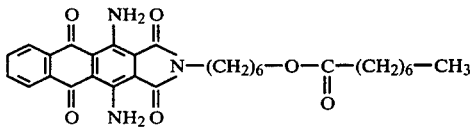

Formula 6:

EXAMPLE VII a. A three necked 1-l round bottom flask equipped with a thermometer, a condenser, and a mechanical stirrer was charged with N-(N',N'-dimethyl-3'-aminopropyl)1,4-diamino-anthraquinone-2,3-dicarboximide (20.0 parts) in o-dichlorobenzene (600.0 parts). The suspension was heated to 150° C. The reaction mixture was maintained at this temperature until complete dissolution had occurred (about 15 minutes), followed by cooling to 60° C. Dimethyl sulfate (9.6 parts) was then added dropwise with a syringe, and a solid mass formed immediately. This mass was then cooled to room temperature, separated by filtration, washed with anhydrous acetone (500.0 parts, dried by reflux over $K_2CO_3$, subsequently distilled under nitrogen, and dried, yielding N-(N',N',N'-trimethyl-3'-ammonium propyl)1,4-diaminoanthraquinone-2,3-dicarboximide methyl sulfate (23.6 parts), which was converted to the tetrafluoroborate by the following procedure:

b. To a fine suspension of N-(N',N',N'-trimethyl-3'-ammonium propyl)1,4-diaminoanthraquinone-2,3-dicarboximide methyl sulfate (20.0 parts) in water (500.0 parts) was added dropwise to a solution of sodium tetrafluoroborate (4.6 parts) in water (50.0 parts) which had been filtered over celite. A heavy precipitate formed immediately. After cooling in ice, it was separated by filtration. Washes with water and drying yielded N-(N',N',N'-trimethyl-3-ammoniumpropyl)1,4-diaminoanthraquinone-2,3-dicarboximide tetrafluoroborate (Formula 7) as a dark reddish blue compound (18.0 parts, 85% overall), which was purified by recrystallization from acetonitrile; m.p.:>310° C.

Calc. for: $C_{22}H_{23}BF_4N_4O_4$: C, 53.46; H, 4.69; N, 11.33; Found: C, 53.21; H, 4.77; N, 11.06.

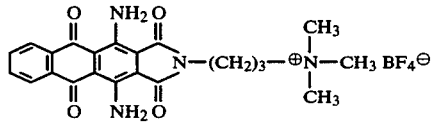

Formula 7;

EXAMPLE VIII a. A three necked 1-l round bottom flask equipped with a thermometer, a condenser, and a mechanical stirrer was charged with N-(N',N'-dibutyl-3'-aminopropyl)1,4-diamino-anthraquinone-2,3-dicarboximide (20.0 parts) in o-dichlorobenzene (600.0 parts). The suspension was heated to 150° C. and maintained at this temperature until complete dissolution had occurred (~15 min), then it was cooled to 60° C. Dimethyl sulfate (8.0 parts) was added dropwise with a syringe. A solid mass formed immediately. This mass was then cooled to room temperature, separated by filtration, washed with anhydrous acetone (500.0 parts, dried by reflux over $K_2CO_3$, subsequently distillated under nitrogen), and dried to yield N-(N',N'-di-n-butyl-N'-methyl-3'-ammonium propyl)1,4-diaminoanthraquinonone-2,3-dicarboximide methyl sulfate (18.1 parts), which was converted to the tetrafluoroborate by the following procedure:

b. To a fine suspension of N-(N',N'-di-n-butyl-N'-methyl-3'-ammonium propyl)1,4-diaminoanthraquinone-2,3-dicarboximide methyl sulfate (10.0 parts) in water (200.0 parts) was added dropwise to a solution of sodium tetrafluoroborate (2.1 parts) in water (50.0 parts) which had been filtered over celite. A heavy precipitate formed immediately. After cooling in ice, the precipitate was separated by filtration. Washes with water and drying yielded N-(N',N'-di-n-butyl-N'-methyl-3-ammoniumpropyl)1,4-diaminoanthraquinone-2,3-dicarboximide tetrafluoroborate (Formula 8) as a dark reddish blue compound (9.5 parts, 72% overall), which was purified by recrystallization from acetonitrile; m.p.: 230°–232° C.; lambdamax 680 nm.

Calculated for: $C_{28}H_{35}BF_4N_4O_4$: C,58.14; H,6.09; N,9.69; Found: C,58.33; H,5.94; N,9.47.

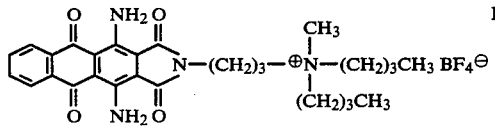

Formula 8:

EXAMPLE IX

A suspension of N-(3'-hydroxypropyl)-1,4-diaminoanthraquinone-2,3-dicarboximide, 20 parts, in pyridine, 400 parts, was heated under nitrogen to 90° C., and maintained at this temperature for 1 hour. The resulting solution was then cooled to 10° C., and p-trifluoromethyl benzoyl chloride, 18 parts was added dropwise. A heavy dark blue precipitate resulted. The reaction mixture was then warmed to room temperature, and after 4 hours, 100 parts of ethanol was added. Upon filtration a dark blue solid was recovered. This solid was then washed with 100 parts of methanol, and dried under a vacuum. There was isolated in 85 percent yield the product N-[3'-(paratrifluoromethylbenzoyl)- propyl-]-1,4-diaminoanthraquinone-2,3-dicarboximide, (Formula 9), melting point of 172° C. to 173° C.

Calculated for: $C_{27}H_{18}N_3O_6F_3$: C, 60.34; H, 3.38; N, 7.82; Found: C, 60.47; H, 3.32; N, 5.57.

Formula 9:

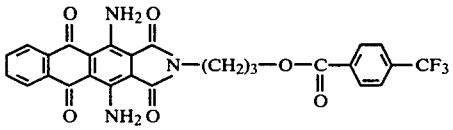

EXAMPLE X

Preparation of toner composition containing N-(N',N'-diethyl-3'-aminopropyl)1,4-diaminoanthraquinone-2,3-dicarboximide:

A toner composition comprised of a styrene n-butyl methacrylate copolymer, (58/42), 96.0 parts), and N-(N',N'-diethyl-3'-aminopropyl)1,4-diaminoanthraquinone-2,3-dicarboximide (Formula 2) (4.0 parts) were mixed on a roll-mill for 24 hours. The resulting mixture was then fed into an extruder at a feed rate of 25 grams/minute, the temperature of the extruder barrel being kept at 140° C. The extrudate (85.2 parts) was collected. It was then ground to an average particle size of 80 microns with a Fitz mill. The powder (70.0 parts) was ground further with a 2" micronizer at a feed rate of 1.4 grams/minute resulting in a cyan toner (65.3 parts), with an average particle size of 10.3 microns.

A developer composition was then prepared by mixing 3 parts by weight of the above prepared toner with 97 parts by weight of carrier particles comprised of a steel core coated with polyvinylidene fluoride, and at three percent toner concentration the toner had a charge of 84 microcoulombs per gram.

Images developed on a photoreceptor incorporated in a xerographic testing apparatus resulted in cyan copies of the desired optical density with low background. The photoreceptor selected was comprised of a trigonal selenium photogenerating layer, and a charge transport layer of the arylamine N,N'-diphenyl-N,N'-bis(3-methylphenyl)1,1'-biphenyl-4,4'-diamine dispersed in a polycarbonate resinous binder, reference U.S. Pat. No. 4,265,990.

EXAMPLE XI

Toner containing N-(6'-n-octanoylhexyl)1,4-diaminoanthraquinone-2,3-dicarboximide:

The toner resin n-butyl methacrylate styrene copolymer, (99.0 parts) and N-(6'-n-octanoylhexyl)1,4-diaminoanthraquinone-2,3-dicarboximide (Formula 6) (1.0 parts) were mixed on a roll-mill for 24 hours. The mixture was fed into an extruder at a feed rate of 25 grams/minute, the temperature of the extruder barrel being maintained at 140° C. The extrudate (83.7 parts) was then collected. Thereafter the extrudate was ground to an average particle size of 80 microns with a Fitz mill. The powder (68.0 parts) was ground further with a 2" micronizer at a feed rate of 1.4 grams/minute yielding the cyano toner (63.9 parts). This toner had an average particle size of 12.0 microns.

A developer composition was then prepared by mixing 3 parts by weight of the above prepared toner with 97 parts by weight of carrier particles comprised of a steel core coated with polyvinylidene fluoride, and at three percent toner concentration the toner had a charge of 54 microcoulombs per gram.

Images developed on a photoreceptor incorporated in a xerographic testing apparatus resulted in cyan copies of the desired optical density with low background. The photoreceptor selected was comprised of a trigonal selenium photogenerating layer, and a charge transport layer of the arylamine N,N'-diphenyl-N,N'-bis(3-methylphenyl)1,1'-biphenyl-4,4'-diamine dispersed in a polycarbonate resinous binder, reference U.S. Pat. No. 4,265,990.

There was prepared in accordance with the above process other cyan toner, and developer compositions comprised of the charge establishing dyes of Formulas 3, 4, 6, 8, and 9. The triboelectric charge in microcoulombs per gram on these toner compositions against a carrier consisting of a steel core coated with polyvinylidene fluoride was determined by repeating the procedure of Example X, with the following results:

| | |
|---|---|
| With compound 3: | |
| 1. At 10 minutes | 80 |
| 2. At 180 minutes | 60 |
| 3. At 5 hours | 60 |
| With compound 4: | |
| 1. At 10 minutes | 80 |
| 2. At 180 minutes | 60 |
| 3. At 5 hours | 60 |
| With compound 6: | |
| 1. At 10 minutes | 52 |
| 2. At 180 minutes | 45 |
| 3. At 5 hours | 40 |
| With compound 8: | |
| 1. At 10 minutes | 100 |
| 2. At 180 minutes | 80 |
| 3. At 5 hours | 70 |
| With compound 9: | |
| 1. At 10 minutes | 40 |
| 2. At 180 minutes | 30 |
| 3. At 5 hours | 25 |

There was also prepared by repeating the procedure of Example XI, magenta, and yellow, toner and developer compositions, with the exception that there was used the dye molecules 1-amino-2-(N,N-di-n-butyl-6-amino-hexyloxy)4-hydroxyanthraquinone, (magenta), and 1-(4'-[N,N-di-methyl-6''-aminohexyl]phenylthio)-5-phenylthioanthraquinone, (yellow), respectively, in place of the 2,3-dicarboximide cyan molecule. These toner compositions when incorporated into the xerographic test fixture of Example XI, enabled similar results, with the exception that magenta, and yellow images were generated.

Other modifications of the present invention may occur to those skilled in the art based upon a reading of the present disclosure and these modifications are intended to be included within the scope of the present invention. Thus colored xerographic images can be developed in accordance with the process described in U.S. Pat. No. 4,311,932 the disclosure of which is totally incorporated herein by reference.

We claim:

1. A dry positively charged colored toner composition comprised of resin particles, and a dye charge control composition represented by the following formula:

X—A—C wherein X is a chromophore molecule, A is a saturated alkylene group, and C is a triboelectric charge establishing group.

2. A toner composition in accordance with claim 1 wherein the dye composition is present in an amount of from about 0.1 percent by weight to about 10 percent by weight.

3. A toner composition in accordance with claim 1 wherein the resin particles are comprised of styrene polymers.

4. A toner composition in accordance with claim 3 wherein the styrene polymers are selected from the group consisting of styrene methacrylate copolymers, styrene acrylate copolymers, and styrene butadiene copolymers.

5. A toner composition in accordance with claim 1 wherein X is a cyan chromophore, a magenta chromophore, or a yellow chromophore.

6. A toner composition in accordance with claim 5 wherein the magenta chromophore is 1-amino-4-hydroxy-2-alkylaminoanthraquinone.

7. A toner composition in accordance with claim 5 wherein the cyan chromophore is 1,4-diaminoanthraquinone-2,3-dicarboximide.

8. A toner composition in accordance with claim 5 wherein the yellow chromophore is 1,5-bis-phenylthioanthraquinone.

9. A toner composition in accordance with claim 1 wherein A is a saturated alkylene group.

10. A toner composition in accordance with claim 9 wherein A is a saturated ethylene, propylene, or butylene.

11. A toner composition in accordance with claim 1 wherein C is selected from the group consisting of amines, quaternary ammonium salts, ethers, thioethers, sulfonamides, amides, biguanides, and esters.

12. A toner composition in accordance with claim 1 wherein C is selected from the group consisting of dimethylamino, dipropylamino and dibutylamino.

13. A toner composition in accordance with claim 1 wherein the dye molecules have incorporated therein solubilizing groups.

14. A toner composition in accordance with claim 13 wherein the solubilizing groups are selected from alkyl groups.

15. A toner composition in accordance with claim 13 wherein the solubilizing groups are butyl.

16. A developer composition comprised of the components of claim 1, and carrier particles.

17. A developer composition in accordance with claim 16 wherein the carrier particles are comprised of a steel core, or nickel berry.

18. A developer composition in accordance with claim 17 wherein the carrier particles are coated with polyvinylidene fluorides, or polystyrene.

19. A method of developing electrostatic latent images comprising forming a negatively charged latent image on a photoresponsive imaging member, contacting the resulting image with a developer composition comprised of carrier particles and a positively charged colored toner composition comprised of resin particles, and molecules represented by the following formula:

X—A—C wherein X is a chromophore molecle, A is a saturated alkylene group, and C is a charge establishing group.

20. A method of imaging in accordance with claim 19 wherein the resin particles are comprised of styrene containing polymers.

21. A method of imaging in accordance with claim 20 wherein the styrene polymers are selected from the group consisting of styrene methacrylate copolymers, styrene acrylate copolymers, and styrene butadiene copolymers.

22. A method of imaging in accordance with claim 19 wherein X is a cyan chromophore, a magenta chromophore, or a yellow chromophore.

23. A method of imaging in accordance with claim 19 wherein the magenta chromophore is 1-amino-4-hydroxy-2-alkylaminoanthraquinone, the cyan chromophore is 1,4-diaminoanthraquinone-2,3-dicarboximide, and the yellow chromophore is 1,5-bis-phenylthioanthraquinone.

24. A method of imaging in accordance with claim 19 wherein A is saturated alkylene group.

25. A method of imaging in accordance with claim 19 wherein C is selected from the group consisting of amines, quaternary ammonium salts, ethers, thioethers, sulfonamides, amides, biguanides, and esters.

26. A method of imaging in accordance with claim 19 wherein the dye compositions have incorporated therein solubilizing groups.

27. A method of imaging in accordance with claim 26 wherein the solubilizing groups are selected from alkyl groups.

28. A method of imaging in accordance with claim 19, wherein the imaging member is comprised of a substrate, a photogenerator, and a diamine hole transport layer.

29. A method of imaging in accordance with claim 28, wherein the photogenerating layer contains metal phthalocyanines, metal free phthalocyanines, vanadyl phthalocyanines, squaraine pigments, azo pigments, or trigonal selenium, optionally dispersed in polymeric resinous binders.

30. A method of imaging in accordance with claim 28, wherein the diamine transport layer is comprised of the amine transport molecule N,N-diphenyl-N,N-bis(-3″-methylphenyl) [1,1′-biphenyl]-4,4diamine, dispersed in an inactive resinous binder.

31. A toner composition in accordance with claim 1, wherein the dye charge control composition is N-(6′-n-octanoylhexyl)1,4-diaminoanthraquinone-2,3-dicarboximide.

32. A toner composition in accordance with claim 1, wherein the dye charge control composition is 1-amino-2-(N,N-di-n-butyl-6-amino-hexyloxy)4-hydroxyanthraquinone.

33. A toner composition in accordance with claim 1, wherein the dye charge control composition is 1-(4′{N,N-di-methyl-6″-aminohexyl}phenylthio)-5-phenylthioanthraquinone.

34. A developer composition in accordance with claim 16, wherein the dye charge control composition is N-(6′-n-octanoylhexyl)1,4-diaminoanthraquinone-2,3-dicarboximide.

35. A developer composition in accordance with claim 16, wherein the dye charge control composition is 1-amino-2-(N,N-di-n-butyl-6-amino-hexyloxy)4-hydroxyanthraquinone.

36. A developer composition in accordance with claim 16, wherein the dye charge control composition is 1-(4′{N,N-di-methyl-6′-aminohexyl}phenylthio)-5-phenylthioanthraquinone.

37. A developer composition in accordance with claim 16, wherein the dye composition is present in an amount of from about 0.1 percent by weight to about 10 percent by weight.

38. A developer composition in accordance with claim 16 wherein the resin particles are comprised of styrene polymers.

39. A developer composition in accordance with claim 38 wherein the styrene polymers are selected from the group consisting of styrene methacrylate copolymers, styrene acrylate copolymers, and styrene butadiene copolymers.

40. A developer composition in accordance with claim 16 wherein X is a cyan chromophore, a magenta chromophore, or a yellow chromophore.

41. A developer composition in accordance with claim 40 wherein the magenta chromophore is 1-amino-4-hydroxy-2-alkylaminoanthraquinone.

42. A developer composition in accordance with claim 40 wherein the cyan chromophore is 1,4-diaminoanthraquinone-2,3-dicarboximide.

43. A developer composition in accordance with claim 40 wherein the yellow chromophore is 1,5-bis-phenylthioanthraquinone.

44. A developer composition in accordance with claim 16 wherein A is a saturated alkylene group.

45. A developer composition in accordance with claim 44 wherein A is a saturated ethylene, propylene, or butylene.

46. A developer composition in accordance with claim 16 wherein C is selected from the group consisting of amines, quaternary ammonium salts, ethers, thioethers, sulfonamides, amides, biguanides, and esters.

47. A developer composition in accordance with claim 16 wherein C is selected from the group consisting of dimethylamino, dipropylamino and dibutylamino.

48. A dry positively charged color toner composition consisting essentially of resin particles and a dye charge control composition represented by the following formula:

$$X—(CH_2)_yC$$

wherein X is a chromophore molecule, y is a number of from 1 to about 20, and C is a triboelectric charge establishing group.

49. A toner composition in accordance with claim 48, wherein X is a number of from 1 to about 5.

50. A toner composition in accordance with claim 48, wherein X is a cyan chromophore, a magenta chromophore, or a yellow chromophore.

51. A toner composition in accordance with claim 48, wherein the dye charge control composition is N-(N',N-dimethyl-3'-aminopropyl)1,4-diaminoanthraquinone-2,3-dicarboximide.

52. A toner composition in accordance with claim 48, wherein the dye charge control composition is selected from the group consisting of N-(N',N'-diethyl-3'-aminopropyl)1,4-diaminoanthraquinone-2,3-dicarboximide; N-(N',N'-di-n-butyl-3'-aminopropyl)1,4-aminoanthraquinone-2,3-dicarboximide; N-(3'-isopropoxypropanol)-1,4-diaminoanthraquinone-2,3-dicarboximide.

53. A developer composition comprised of the components of claim 48 and carrier particles.

54. A developer composition in accordance with claim 53, wherein the carrier particles are comprised of a steel core.

55. A developer composition in accordance with claim 53, wherein the carrier particles contain a coating thereover.

* * * * *